US011598578B2

(12) United States Patent
Kennedy et al.

(10) Patent No.: US 11,598,578 B2
(45) Date of Patent: Mar. 7, 2023

(54) LOW PRESSURE ETHANE LIQUEFACTION AND PURIFICATION FROM A HIGH PRESSURE LIQUID ETHANE SOURCE

(71) Applicant: GE Oil & Gas, Inc., Houston, TX (US)

(72) Inventors: David Allen Kennedy, Schertz, TX (US); Thomas Lyons, Schertz, TX (US); Christopher Yount, Schertz, TX (US)

(73) Assignee: Baker Hughes Energy Services LLC, Houston, TX (US)

( * ) Notice: Subject to any disclaimer, the term of this patent is extended or adjusted under 35 U.S.C. 154(b) by 337 days.

(21) Appl. No.: 15/508,212

(22) PCT Filed: Sep. 2, 2014

(86) PCT No.: PCT/US2014/053654
§ 371 (c)(1),
(2) Date: Mar. 2, 2017

(87) PCT Pub. No.: WO2016/036344
PCT Pub. Date: Mar. 10, 2016

(65) Prior Publication Data

US 2017/0307291 A1 Oct. 26, 2017

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0052* (2013.01); *F25J 1/0085* (2013.01);
(Continued)

(58) Field of Classification Search
CPC ..... F25J 1/022; F25J 1/0217; F25J 1/0218; F25J 1/0219; F25J 1/006; F25J 1/0092;
(Continued)

(56) References Cited

U.S. PATENT DOCUMENTS 4,004,430 A * 1/1977 Solomon ..... F25J 3/0209 62/621
5,979,177 A 11/1999 Sumner et al.
(Continued)

FOREIGN PATENT DOCUMENTS

CN 1688855 A 10/2005
CN 1784578 A 6/2006
(Continued)

OTHER PUBLICATIONS

International Search Report and Written Opinion issued in connection with corresponding PCT Application No. PCT/US14/053654 dated May 20, 2015.

*Primary Examiner* — Tavia Sullens
(74) *Attorney, Agent, or Firm* — Baker Hughes Patent Organization

(57) ABSTRACT

A plant and process are used to liquefy and purify a high pressure ethane feed stream. The plant includes a cascaded refrigeration system that refrigerates the ethane feed stream. The refrigeration system includes a propylene circuit, an ethylene circuit and a mixed refrigerant circuit. The mixed refrigerant circuit includes a refrigerant that includes ethane and methane. The plant includes a demethanizer that is configured to remove methane and other natural gas liquids from the refrigerated ethane stream.

15 Claims, 3 Drawing Sheets

(52) U.S. Cl.
CPC ..... *F25J 1/0087* (2013.01); *F25J 1/0218* (2013.01); *F25J 1/0219* (2013.01); *F25J 1/0237* (2013.01); *F25J 1/0271* (2013.01); *F25J 1/0283* (2013.01); *F25J 1/0284* (2013.01); *F25J 1/0289* (2013.01); *F25J 1/0294* (2013.01); *F25J 2215/62* (2013.01); *F25J 2220/02* (2013.01); *F25J 2220/04* (2013.01); *F25J 2240/40* (2013.01); *F25J 2245/90* (2013.01); *F25J 2270/60* (2013.01); *F25J 2270/66* (2013.01)

(58) Field of Classification Search
CPC ..... F25J 1/0085; F25J 1/0087; F25J 2270/66; F25J 2270/60
See application file for complete search history.

(56) References Cited

U.S. PATENT DOCUMENTS

| | | | | |
|---|---|---|---|---|
| 6,021,647 | A | 2/2000 | Ameringer et al. | |
| 7,082,787 | B2 | 8/2006 | Lee et al. | |
| 7,442,233 | B2 * | 10/2008 | Mitariten | B01D 53/0462 423/228 |
| 7,713,497 | B2 | 5/2010 | Mak | |
| 2004/0237580 | A1 | 12/2004 | Mak | |
| 2005/0198998 | A1 * | 9/2005 | Lee | F25J 3/0219 62/612 |
| 2006/0162378 | A1 * | 7/2006 | Roberts | F25J 1/0022 62/612 |
| 2010/0251764 | A1 * | 10/2010 | Johnke | F25J 3/0209 62/620 |
| 2011/0132033 | A1 * | 6/2011 | Prim | F25J 3/0209 62/618 |
| 2012/0123578 | A1 * | 5/2012 | Ransbarger | F25J 1/0022 700/104 |
| 2013/0327085 | A1 | 12/2013 | Eaton | |
| 2015/0135767 | A1 * | 5/2015 | Currence | F25J 3/0209 62/612 |

FOREIGN PATENT DOCUMENTS

| | | | |
|---|---|---|---|
| CN | 101479549 | B | 8/2011 |
| CN | 1969161 | B | 7/2013 |
| WO | 2004083753 | A2 | 9/2004 |

* cited by examiner

LOW PRESSURE ETHANE LIQUEFACTION AND PURIFICATION FROM A HIGH PRESSURE LIQUID ETHANE SOURCE

BACKGROUND

Embodiments of the invention relate generally to ethane processing and more particularly, but not by way of limitation, to a steady-state process for liquefying and purifying a high pressure ethane stream.

Ethane is a natural gas liquid (NGL) that is primarily used as feedstock for petrochemical production and for ethylene plastic manufacturing. Ethane and other natural gas liquids are typically removed from natural gas at a processing plant and transferred to purchasers in pipelines. Because ethane boils at about −127° F. at atmospheric pressure, it is necessary to pressurize ethane for shipment by pipeline at practical temperatures (e.g., 800 psig at 70° F.).

Recently, it has become desirable to transfer ethane by ship to overseas markets. Due to the complexities of transferring liquids under elevated pressures, it may be desirable to transfer the ethane at near atmospheric pressures under refrigerated conditions. Embodiments of the present invention are directed at improved methods for an efficient process for producing a liquefied ethane stream at near atmospheric pressures and below boiling point temperatures.

BRIEF DESCRIPTION

In an embodiment, the present invention includes a plant and method of operation for liquefying and purifying a high pressure ethane stream. In an embodiment, the method includes the steps of dehydrating the ethane stream, refrigerating the dehydrated ethane stream to produce a liquefied ethane stream at near atmospheric pressure, and transporting the liquefied ethane steam to an ethane storage facility. The step of refrigerating the dehydrated ethane stream includes the steps of passing a propylene refrigerant through a first refrigeration circuit, passing the dehydrated ethane feed stream through the first refrigeration circuit, passing an ethylene refrigerant through a second refrigeration circuit, passing the dehydrated ethane feed stream through the second refrigeration circuit, passing a mixed refrigerant through a third refrigeration circuit, and passing the dehydrated ethane feed stream through the third refrigeration circuit. The process optionally includes the additional steps of capturing boil-off gases from the ethane storage facility and transporting the boil-off gases to a gas pipeline.

In another aspect, the plant and method of operation include a method for refrigerating an ethane feed stream through a plurality of cascaded refrigeration circuits. The method includes passing a propylene refrigerant through a first refrigeration circuit, passing the ethane feed stream through the first refrigeration circuit, passing an ethylene refrigerant through a second refrigeration circuit, passing the ethane feed stream through the second refrigeration circuit, passing a mixed refrigerant through a third refrigeration circuit, and passing the ethane feed stream through the third refrigeration circuit.

In yet another aspect, the embodiments include a method for liquefying and purifying a high pressure ethane feed stream that includes the steps of dehydrating the ethane feed stream, refrigerating the dehydrated ethane feed stream, and demethanizing a portion of the refrigerated ethane feed stream. The step of refrigerating the dehydrated ethane feed stream further includes passing the dehydrated ethane feed stream through a plurality of cascaded refrigeration circuits.

DETAILED DESCRIPTION

The embodiments of the present invention include an improved plant and method of operation for liquefying and purifying a stream of high pressure ethane. The plant and process are well-suited to create refrigerated liquid ethane at near atmospheric pressure from a high pressure pipeline-supplied feed of natural gas liquid (NGL).

Figure 1:
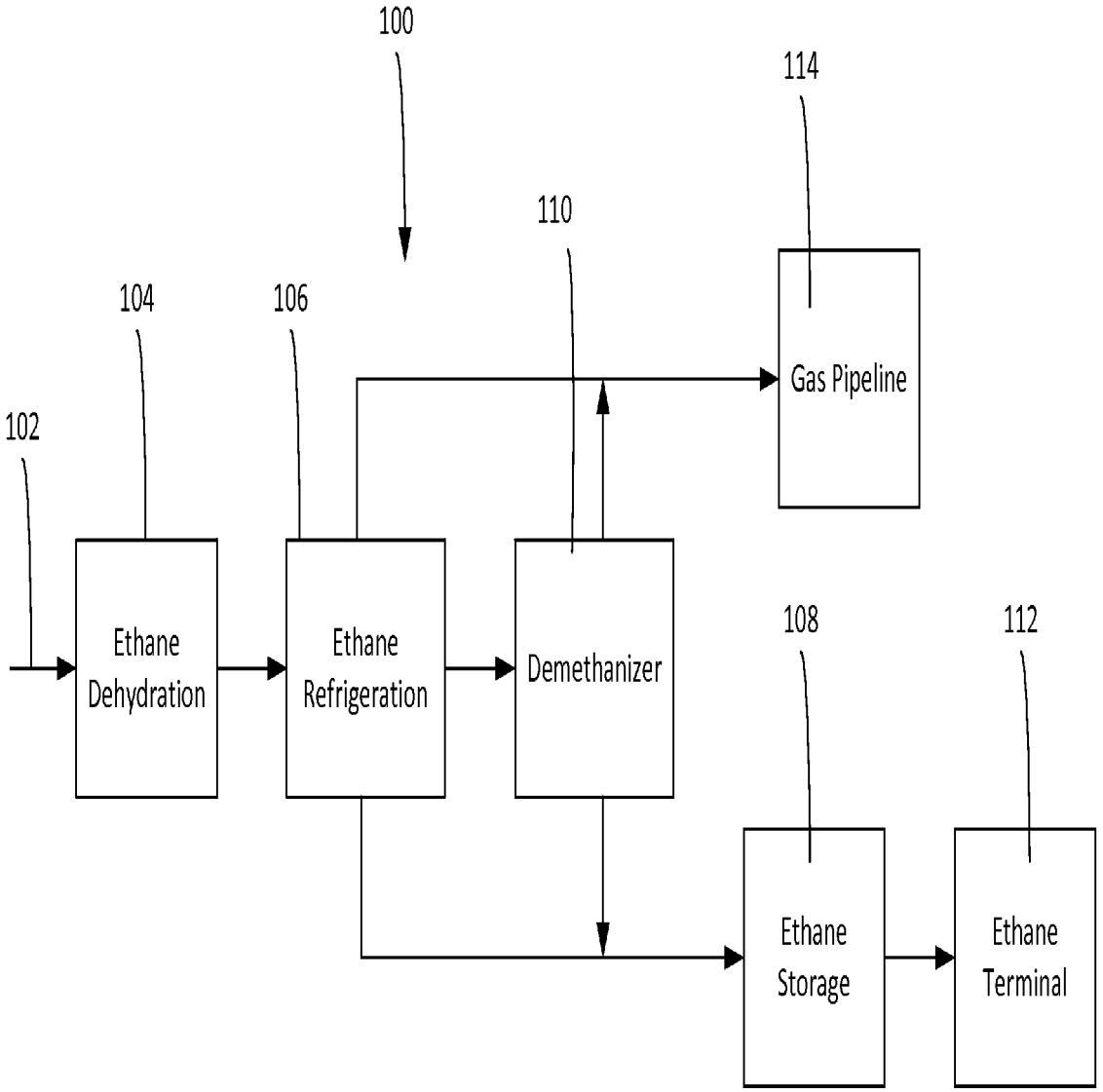
FIG. 1 provides a process flowchart of an embodiment of the ethane liquefaction and purification process.

Referring first to FIG. 1, shown therein is a functional flowchart depicting an embodiment of a processing plant 100 configured for liquefying and purifying a feed stream 102 of high pressure pipeline ethane. In particular embodiments, the ethane feed stream 102 is about 95% pure ethane at a pressure of about 800 psig and at a temperature of about 70° F. The plant 100 generally includes a dehydration unit 104, a refrigeration complex 106, ethane storage 108 and a demethanizer module 110. Following refrigeration, liquid ethane streams from the ethane storage 108 and demethanizer module 110 are fed to a liquefied ethane terminal 112 or downstream storage and gaseous methane from the demethanizer module 110 is fed to a natural gas pipeline 114. In addition to the ethane feed stream 102, the plant 100 also may require a source of cooled water, cooled oil, electrical power and fuel gas. In a particular embodiment, the plant 100 is configured to operate in a steady-state manner to produce substantially pure liquefied ethane at a temperature of about −155° F. and at a pressure of about 0.5 psig. Methane recovered from the plant 100 is compressed and transferred to the natural gas pipeline 114.

Figure 2:
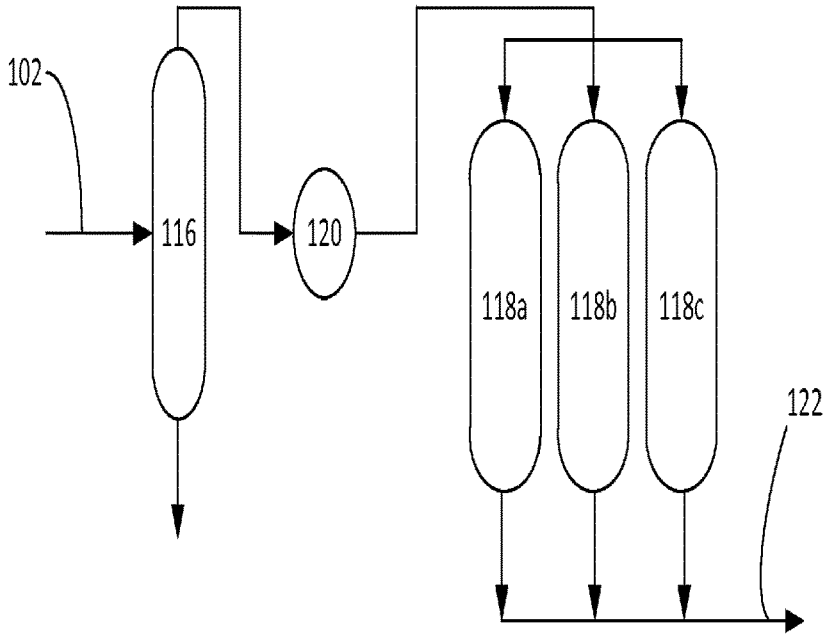
FIG. 2 provides a process flowchart of a dehydration unit constructed in accordance with an embodiment.

Turning to FIG. 2, shown therein is a functional depiction of the dehydration unit 104. The ethane feed stream 102 in the source pipeline may be saturated with water and contain methane and small quantities of other natural gas liquids, including propane, ethylene and propylene. It is desirable to remove water, methane and other natural gas liquids from the ethane feed stream 102.

The dehydration unit 104 may include a liquid-liquid separator 116 and one or more dehydrator molecular beds 118. The feed stream 102 first passes through the liquid-liquid separator 116 to remove any free water and then through a flow meter 120 before entering the one or more beds 118. The beds 118 remove any remaining water from the feed stream 102 to create a dehydrated liquid ethane stream 122.

In the particular embodiment depicted in FIG. 2, the dehydration unit 104 employs three molecular sieve beds 118*a*, 118*b* and 118*c* with solid desiccants in each bed 118. The feed stream 102 is sequentially rotated through the beds 118 such that the feed stream 102 is provided to a first bed 118*a* while a second bed 118*b* is being heated to regenerate the desiccant and a third bed 118*c* is cooling following regeneration in preparation for a subsequent on-line cycle. At the end of a cycle, the regenerated and cooled bed 118*c* is placed back on-line and liquid is drained from the off-line bed 118*a*. After the exhausted bed 118*a* has been drained and depressurized, it is regenerated by heating with a regeneration gas. After regeneration, the bed 118*a* is allowed to cool and then pressurized in preparation for a subsequent loading cycle. In a particular embodiment, the regeneration gas is composed of the compressor fuel gas supply which is heated, used in the dehydration unit 104, and then cooled. Water is knocked out of the fuel gas before it is routed for use as fuel in compressors located in the plant 100.

Figure 3:
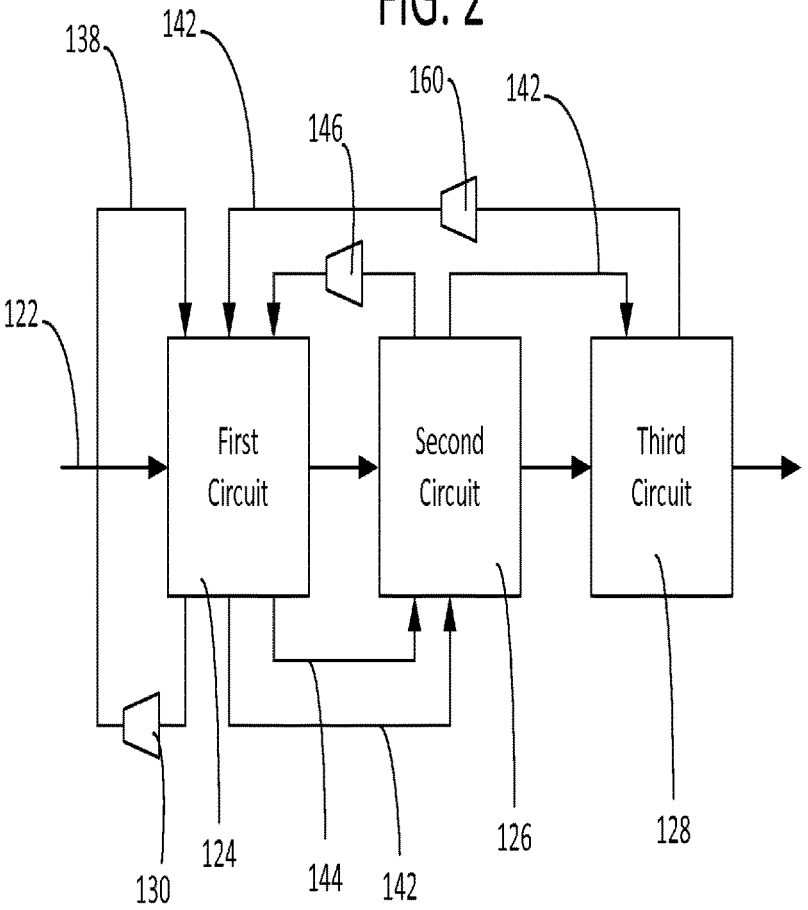
FIG. 3 provides a process flowchart of a refrigeration scheme of the process of FIG. 1.

Turning to FIG. 3, the dehydrated liquid ethane stream 122 is routed to the refrigeration complex 106 from the dehydration unit 104. Generally, the refrigeration complex 106 includes a cascade refrigeration system that includes a plurality of refrigeration circuits. Turning to FIG. 3, shown therein is a functional diagram of the refrigeration complex 106. In the particular embodiment depicted in FIG. 3, the refrigeration complex 106 includes three cascaded refrigeration circuits that reduce the temperature of the dehydrated liquid ethane stream 122 from about 70° F. to about −155° F. More specifically, the refrigeration complex 106 includes a first refrigeration circuit 124 that utilizes propylene as a primary refrigerant, a second refrigeration circuit 126 that utilizes ethylene as a primary refrigerant and a third refrigeration circuit 128 that utilizes a mixed refrigerant. In a particular embodiment, the mixed refrigerant includes about 75% by volume methane and about 25% by volume methane.

Propylene may be used as the refrigerant for the first refrigeration circuit 124 because propylene condenses at 105° F. and 227 psig and liquid propylene boils at −41° F. at 5 psig. Ethylene may be used as the refrigerant for the second refrigerant circuit 126 because ethylene condenses at 14° F. and 184 psig and liquid ethylene boils at −146° F. at 5 psig. When cascaded in a two-stage refrigeration circuit, propylene and ethylene are effective at cooling the dehydrated ethane feed stream 122 to about −143° F. However, because the dehydrated ethane feed stream 122 may include methane and other natural gas liquids, it is necessary to cool the dehydrated ethane feed stream 122 to about −155° F. to achieve near total liquefaction at near atmospheric pressure. Accordingly, the third refrigeration circuit 128 is used with the ethane/methane mixed refrigerant to reduce the temperature of the dehydrated liquid ethane stream 122 to about −155° F. Notably, the ethylene refrigerant used in the second refrigeration circuit 126 is passed through the first refrigeration circuit 124 and the mixed refrigerant used in the third refrigeration circuit 128 is passed through both the first and second refrigeration circuits 124, 126.

Figure 4:
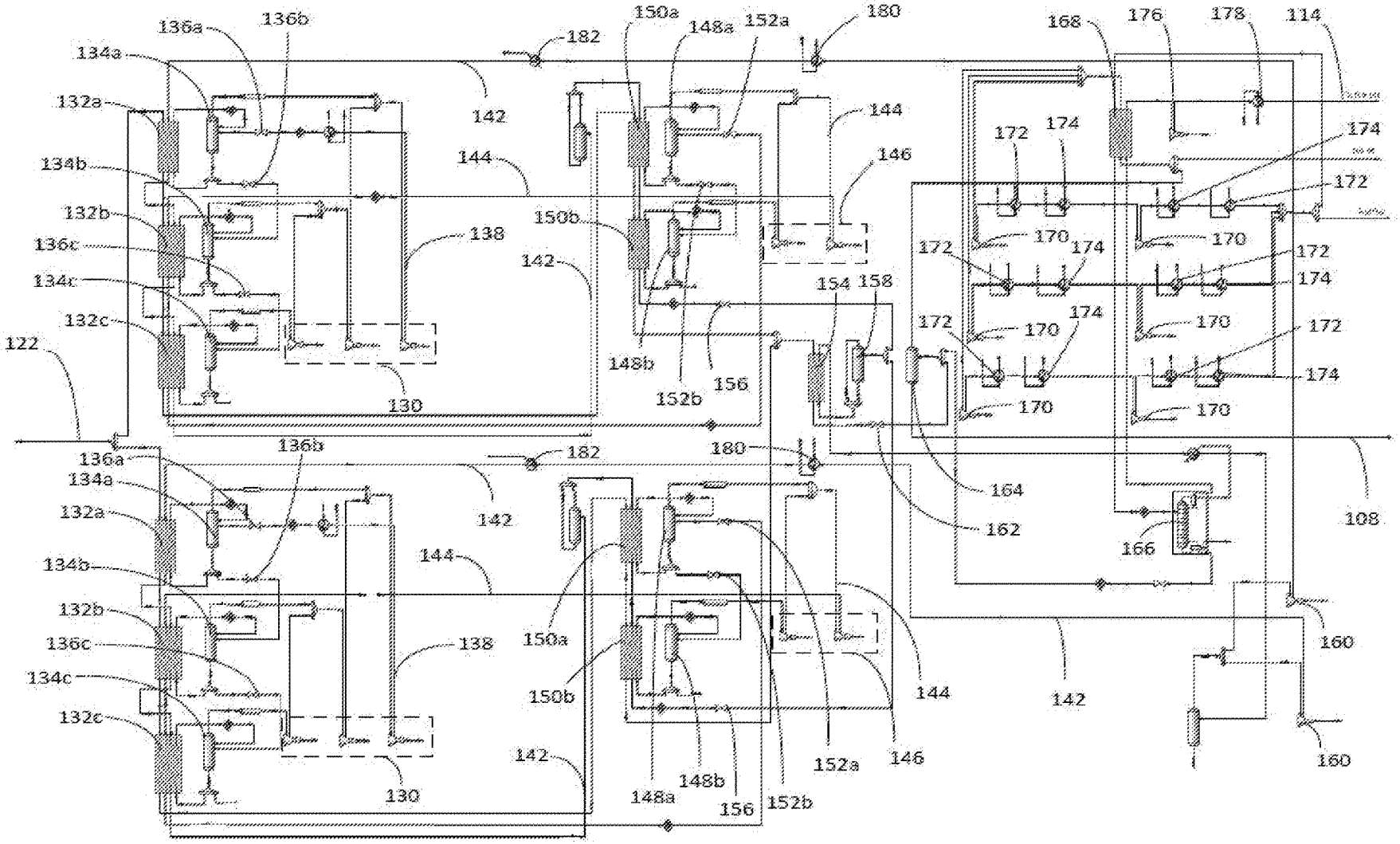
FIG. 4 is piping and instrument diagram for embodiments of the liquefaction and purification process of FIG. 1.

Turning to FIG. 4, shown therein is a piping and instrument diagram of a particular embodiment of the plant 100. After drying, the dehydrated liquid ethane stream 122 is cooled to approximately −45° F. by the first refrigeration circuit 124. The first refrigeration circuit 124 may include a pair of substantially equivalent cooling trains that are each configured to cool about half of the dehydrated ethane steam 122. Each train within the first refrigeration circuit 124 may include a propylene compressor 130, three propylene heat exchangers 132*a* 132*b* and 132*c*, three propylene thermosyphon vessels 134*a*, 134*b* and 134*c*, and three propylene expansion valves 136*a*, 136*b* and 136*c*.

Each compressor 130 compresses propylene refrigerant 138 used in each respective train. In an embodiment, each propylene compressor 130 is a three-stage compressor that is powered by a gas turbine. Suitable gas turbines include model LM6000 gas turbines manufactured by General Electric. In the final stage of compression, propylene will be compressed to about 132 psig and cooled to about 105° F. through a bank of water-cooled shell and tube heat exchangers 140. A cooling tower (not shown) will be used for cooling water supply to the plant 100. At 105° F. the propylene will be condensed and this liquid will feed the first propylene expansion valve 136*a* to produce propylene at approximately 32° F. and 69 psig. This mixed phase stream, with a vapor fraction of about 0.285, feeds the first thermosyphon vessel 134*a* and provides the necessary refrigeration through the first propylene heat exchanger 132*a*. The first propylene heat exchanger 132*a* cools the dehydrated ethane feed 122 to approximately 35° F. The first propylene heat exchanger 132*a* also provides the first cooling to the mixed refrigerant 142 from the third refrigeration circuit 128. The first propylene heat exchanger 132*a* may be a brazed aluminum heat exchanger. It will be appreciated that the propylene heat exchangers 132 may be separate units or a single unit with separate sections.

Vapor from the first propylene thermosyphon vessel 134*a* is combined with the second stage discharge from the propylene compressor 130. Liquid at 69 psig and 32° F. from the first propylene thermosyphon vessel 134*a* feeds the second propylene expansion valve 136*b* to produce propylene at approximately −8° F. and 26 psig. This mixed phase propylene stream, with a vapor fraction of about 0.125, feeds the second propylene thermosyphon vessel 134*b* and provides the necessary refrigeration through the second propylene heat exchanger 132*b*. The second propylene heat exchanger 132*b* may be a brazed aluminum heat exchanger.

The second propylene heat exchanger 132*b* cools the dehydrated ethane stream 122, the mixed refrigerant stream 142 and an ethylene refrigerant stream 144 to approximately 5° F. The ethylene refrigerant stream 144 from the second refrigeration circuit 126 enters the second propylene heat exchanger 132*b* at approximately 14° F. and 184 psig.

Vapor from the second propylene thermosyphon vessel 134*b* is combined with the discharge from the first stage of the propylene compressor 130. Liquid propylene 138 at 26 psig and 8° F. from the second propylene thermosyphon vessel 134*b* feeds a third propylene expansion valve 136*c* to produce propylene at approximately 2 psig and −48° F. This mixed phase propylene stream, with a vapor fraction of 0.108, feeds the third propylene thermosyphon vessel 134*c* and the third propylene heat exchanger 132*c*. The third propylene heat exchanger 132*c* can be configured as two double core and kettle heat exchangers. Liquid from the third propylene thermosyphon vessel 134*c* provides the bath in which these two double core, brazed aluminum heat exchangers 132*c* are immersed. Through one set of double core exchangers 132*c* passes the mixed refrigerant stream 142 from the third refrigeration circuit 128 and is cooled to 45° F. Through one core of the second double core and kettle exchanger 132*c* the dehydrated ethane stream 122 is cooled to −45° F. and through the other core the liquid ethylene stream 144 from the second refrigeration circuit 126 is cooled to −45° F. Vapor boiling from the bath inside the core and kettle heat exchanger 132*c* makes up the first stage suction of the propylene compressor 130.

After cooling to −45° F. in the first refrigeration circuit 124, the dehydrated liquid ethane stream 122 and mixed refrigerant stream 142 are further cooled to −101° F. with the second refrigeration circuit 126, ethylene refrigeration system. The second refrigeration circuit 126 may include two refrigeration trains that operate in parallel to cool half of the dehydrated ethane stream 122. Each train within the second refrigeration circuit 126 may include an ethylene compressor 146, a pair of ethylene thermosyphon vessels 148*a*, 148*b*, a pair of ethylene heat exchangers 150*a*, 150*b* and a pair of ethylene expansion valves 152*a*, 152*b*. It will be appreciated that the ethylene heat exchangers 150 may be separate units or a single unit with separate sections.

In a particular embodiment, each ethylene compressor 146 is driven by an electric motor. Suitable electric motors produce about 4,400 horsepower and are available from General Electric. The ethylene compressor 146 includes two stages and will provide two levels of refrigeration. In the final stage of compression, the ethylene refrigerant stream 144 will be compressed to 184 psig and 14° F. The ethylene stream 144 is cooled to about −45° F. in the first refrigeration circuit 124 with the propylene refrigeration system.

At −45° F. the ethylene refrigerant stream 144 will be condensed and this liquid will feed the first ethylene expansion valve 152*a* to produce ethylene at approximately −80° F. and 86 psig. This mixed phase stream, with a vapor fraction of 0.134, feeds the first ethylene thermosyphon vessel 148*a* and provides the necessary refrigeration through the first section of the brazed aluminum heat exchanger 150*a* to cool the dehydrated ethane feed 122 from −45° F. to approximately −77° F. The first ethylene heat exchanger 150*a* will also cool the mixed refrigerant stream 142 leaving the first refrigeration circuit 124 from about −45° F. to approximately −77° F.

Vapor from the first ethylene thermosyphon vessel 148*a* is combined with the first stage discharge from the ethylene compressor 146. Liquid ethylene at 86 psig and −80° F. from the first ethylene thermosyphon vessel 148*a* feeds a second ethylene expansion valve 152*b* to produce an ethylene stream 144 at approximately −104° F. and 45 psig. This mixed phase stream, with a vapor fraction of 0.079, feeds the second ethylene thermosyphon vessel 148*b* and provides the necessary refrigeration through the second section of the brazed aluminum heat exchanger 150*b* to cool the dehydrated ethane feed 122 and mixed refrigerant stream 142 to approximately −101° F.

After cooling to −101° F. with ethylene in the second refrigeration circuit 126, the two liquid dehydrated ethane streams 122 and two mixed refrigerant streams 142 from the separate refrigeration trains are each combined so that final refrigeration in the third refrigeration circuit 126 will be done with a single mixed refrigerant heat exchanger 154. In addition to the mixed refrigerant heat exchanger 154, the third refrigeration circuit 126 includes a mixed refrigerant expansion valve 156, a mixed refrigerant thermosyphon vessel 158 and a pair of mixed refrigerant compressors 160.

The mixed refrigerant heat exchanger 152 may be a double core and kettle design. Sub-cooled mixed refrigerant 142 at −101° F. feeds the mixed refrigerant expansion valve 156 to produce mixed refrigerant at approximately 6 psig and −162° F. This mixed phase stream, with a vapor fraction of 0.269, feeds the double core and kettle mixed refrigerant heat exchanger 154. Liquid from this mixed refrigerant stream 142 comprises the bath in which these double core brazed aluminum heat exchangers 154 are immersed. Through these heat exchangers 154, the dehydrated liquid ethane stream 122 is cooled to −152° F.

The combined liquid ethane outlets feed an ethane expansion valve 162 to produce ethane at 0.5 psig and −155° F. This mixed phase stream with a vapor fraction of 0.031, is transferred to s separator vessel 164. Liquids from the separator vessel 164 are sent to the ethane storage 108 (not depicted in FIG. 4) and gases are routed to the demethanizer module 110. Liquefied ethane from ethane storage 108 can then be transferred to the liquefied ethane terminal 112, where it will be loaded onto ships for transportation. Because the storage temperature is not designed to be lower than −155° F. and the methane concentration is too high to allow for total liquefaction, the demethanizer module 110 is utilized to remove methane and other gases from ethane in the ethane storage 108.

The demethanizer module 110 generally includes a demethanizer column 166, a demethanizer heat exchanger 168 and a plurality of demethanizer compressors 170. Combined flash from the separator vessel 164 and boil-off gas from the ethane storage 108 at approximately 0.5 psig and −155° F. are heated to approximately 29° F. through one pass through the demethanizer heat exchanger 168. The demethanizer heat exchanger 168 may be a three-pass, brazed aluminum boil-off heat exchanger. The boil-off gas is next compressed with the demethanizer compressors 170 to about 475 psig to meet the minimum pressure requirement for fuel gas for the turbines in the plant 100. The demethanizer compressors 170 can be split into three trains to fit the largest screw compressor packages available. Each train will consist of a booster and a high stage compressor. The booster compressor will compress boil-off gas to approximately 95 psig and by means of oil injection coolers 172 that maintain the discharge temperature at approximately 200° F. The boil-off gas will be further cooled to 105° F. with a water-cooled shell and tube heat exchangers 174. Oil cooling will also be by means of a water cooled shell and tube heat exchanger. The high stage compressor will be similarly cooled with the final combined discharges at 475 psig and 105° F.

From this discharge line the required fuel gas will be first used for regeneration of the ethane dehydration unit 104 before supplying fuel gas for the turbines in the plant 100. The balance of the boil-off gas will flow through a second pass of the demethanizer heat exchanger 168 and cooled to approximately −68° F. to feed the demethanizer column 166.

Condenser duty for the demethanizer column 166 is provided by the mixed refrigerant 142 vapor return from the core and kettle bath of the mixed refrigerant heat exchanger 154. The temperature of this stream is approximately −127° F. and it will be warmed up to −125° F. to feed the mixed refrigerant compressors 160. Heat for the reboiler on the demethanizer column 166 will be provided by the discharges of the mixed refrigerant compressors 160. Liquid from the bottom of the demethanizer column 166 will be approximately 99% pure ethane that will be mixed with the ethane line to ethane storage 108. Vapor overheads from the demethanizer column will contain less than 6% ethane at approximately 465 psig and −103° F. The overheads stream will go through the third pass of the demethanizer heat exchanger 168. The overheads stream, now at 102° F., will be compressed to 800 psig with a pipeline compressor 176 for insertion into the gas pipeline 114. A water-cooled shell and tube heat exchanger 178 is installed on the discharge of the pipeline compressor 176 to decrease the discharge temperature to 105° F.

Mixed refrigerant at 0.76 psig and −125° F. from the condenser of the demethanizer column 166 is split into two streams and compressed to 209 psig with the mixed refrigerant compressors 160. The mixed refrigerant discharge streams 142 are first cooled from 160° F. to 105° F. through a water-cooled shell and tube heat exchanger 180. This stream is next cooled to approximately 73° F. with a second heat exchanger 182 as it is used as a heat source for the reboiler in the demethanizer column 166. The mixed refrigerant stream is then used in the first refrigeration circuit 124 as describe above.

Thus, the plant 100 is configured to convert a high-pressure ethane feed 102 into liquefied, refrigerated and purified ethane that is well suited for transportation by ship. The plant 100 employs a three-circuit, cascaded refrigeration system that efficiently reduces the temperature of the ethane feed. Notably, the cascaded refrigeration circuit uses propylene as the refrigerant in the first circuit 124, ethylene as the refrigerant in the second circuit 126 and a mixed refrigerant that includes ethane and methane in the third circuit 128. The ethylene refrigerant is passed through the first refrigeration circuit 124 and the mixed ethane-methane refrigerant is passed through the first and second refrigeration circuits 124, 126. Once refrigerated and stored at near atmospheric pressures, methane is removed from boil-off gas and used as fuel gas for turbines within the plant 100 or transferred to a natural gas pipeline. The plant 100 is highly scalable and can be configured to process a wide variety of ethane feedstock and produce purified, liquefied ethane under a range of conditions.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A method for liquefying and purifying a high pressure ethane feed stream, the method comprising:

receiving an ethane feed stream from a high pressure pipeline source;

dehydrating the ethane feed stream by sequentially rotating the ethane feed stream through a plurality of inter-connected molecular sieve beds configured within a dehydration unit at which the ethane feed stream is received; and refrigerating the dehydrated ethane feed stream by:

passing a propylene refrigerant through a first refrigeration circuit comprising at least one propylene compressor and at least one propylene heat exchanger configured to refrigerate the dehydrated ethane feed stream;

passing the dehydrated ethane feed stream through the first refrigeration circuit;

passing an ethylene refrigerant through a second refrigeration circuit including an ethylene heat exchanger configured to refrigerate the dehydrated ethane feed stream;

passing the dehydrated ethane feed stream through the second refrigeration circuit;

passing a mixed refrigerant through a third refrigeration circuit including a mixed refrigerant heat exchanger configured to refrigerate the dehydrated ethane feed stream;

passing the dehydrated ethane feed stream through the third refrigeration circuit; and demethanizing a portion of the refrigerated dehydrated ethane feed stream, wherein one of the at least one propylene heat exchangers is configured as two double core and kettle heat exchangers immersed in a liquid bath, wherein the mixed refrigerant stream from the third refrigeration circuit passes through a first of the two double core and kettle heat exchangers, wherein the dehydrated ethane feed stream from the first refrigeration circuit passes through a first core of a second of the two double core and kettle heat exchangers, and the dehydrated ethane feed stream from the second refrigeration circuit passes through a second core of the second of the double core and kettle heat exchangers, and wherein a vapor boiling from the liquid bath is drawn through a first stage suction side of at least one of the at least one propylene compressor.

2. The method of claim 1, wherein the ethane feed stream is provided to a first bed, of the plurality of inter-connected molecular sieve beds, while a second bed, of the plurality of inter-connected molecular sieve beds, is heated via a regeneration gas to regenerate a desiccant within the second bed, and while a third bed, of the plurality of inter-connected molecular sieve beds, is cooled following a previous rotation sequence of an ethane feed stream through the dehydration unit.

3. The method of claim 1, wherein the mixed refrigerant includes methane and ethane.

4. The method of claim 3, wherein the mixed refrigerant comprises 75% ethane and 25% methane.

5. The method of claim 1, further comprising the step of passing the ethylene refrigerant through the first refrigeration circuit prior to passing the ethylene refrigerant through the second refrigeration circuit.

6. The method of claim 5, further comprising passing the mixed refrigerant through the first refrigeration circuit prior to passing the mixed refrigerant through the third refrigeration circuit.

7. The method of claim 6, further comprising passing the mixed refrigerant through the second refrigeration circuit after passing the mixed refrigerant through the first refrigeration circuit and before passing the mixed refrigerant through the third refrigeration circuit.

8. The method of claim 1, wherein the demethanizing of a portion of the refrigerated ethane feed stream further comprises:

passing the refrigerated ethane feed stream through a separator vessel;

transporting liquefied ethane from the separator vessel to an ethane storage facility; and passing flash gases from the separator vessel to a demethanizer column.

9. The method of claim 8, wherein the demethanizing a portion of the refrigerated ethane feed stream further comprises passing the mixed refrigerant to a condenser in the demethanizer column.

10. The method of claim 1, wherein the demethanizing of a portion of the refrigerated ethane feed stream further comprises:

separating liquefied ethane from methane and other gases in a demethanizer column;

and transporting the liquefied ethane from the demethanizer column to an ethane storage facility.

11. The method of claim 10, wherein the dehydrating of the ethane feed stream further comprises passing the ethane feed stream through a liquid-liquid separator.

12. The method of claim 11, wherein the dehydrating of the ethane feed stream further comprises regenerating the plurality of inter-connected molecular sieve beds by passing the gases produced by the demethanizer column through the plurality of inter-connected molecular sieve beds.

13. A method for liquefying and purifying a high pressure ethane feed stream, the method comprising:

receiving an ethane feed stream from a high pressure pipeline source;

dehydrating the ethane stream by sequentially rotating the ethane feed stream through a plurality of inter-connected molecular sieve beds configured within a dehydration unit at which the ethane feed stream is received; and refrigerating the dehydrated ethane feed stream to produce a liquefied ethane feed stream by:

passing a propylene refrigerant through a first refrigeration circuit including at least one propylene compressor and at least one propylene heat exchanger configured to refrigerate the dehydrated ethane feed stream;

passing the dehydrated ethane feed stream through the first refrigeration circuit;

passing an ethylene refrigerant through a second refrigeration circuit including an ethylene heat exchanger configured to refrigerate the dehydrated ethane feed stream;

passing the dehydrated ethane feed stream through the second refrigeration circuit;

passing a mixed refrigerant through a third refrigeration circuit including a mixed refrigerant heat exchanger configured to refrigerate the dehydrated ethane feed stream;

passing the dehydrated ethane feed stream through the third refrigeration circuit;

demethanizing a portion of the refrigerated dehydrated ethane feed stream;

transporting the liquefied ethane feed stream to an ethane storage facility;

capturing boil-off gases from the ethane storage facility; and transporting the boil-off gases to a gas pipeline, wherein one of the at least one propylene heat exchangers is configured as two double core and kettle heat exchangers immersed in a liquid bath, wherein the mixed refrigerant stream from the third refrigeration circuit passes through a first of the two double core and kettle heat exchangers, wherein the dehydrated ethane feed stream from the first refrigeration circuit passes through a first core of a second of the two double core and kettle heat exchangers, and the dehydrated ethane feed stream from the second refrigeration circuit passes through a second core of the second of the double core and kettle heat exchangers, and wherein a vapor boiling from the liquid bath is drawn through a first stage suction side of at least one of the at least one propylene compressor.

14. The method of claim 13, wherein the ethylene refrigerant passes through the first refrigeration circuit before passing through the second refrigeration circuit.

15. The method of claim 14, wherein the mixed refrigerant is passed through the first refrigeration circuit and the second refrigeration circuit before passing through the third refrigeration circuit.

* * * * *